US005511672A

United States Patent [19]

Young et al.

[11] Patent Number: 5,511,672

[45] Date of Patent: Apr. 30, 1996

[54] SORTING DEVICE AND METHOD

[76] Inventors: Robert D. Young, 700 Queens Hwy., Accord, N.Y. 12404; Daniel D. Young, 20 Peak Rd., Stone Ridge, N.Y. 12484

[21] Appl. No.: 140,880

[22] Filed: Oct. 25, 1993

[51] Int. Cl.[6] ..... B07C 5/00; B42F 17/00; G09F 3/20

[52] U.S. Cl. ..... 209/546; 209/630; 209/706; 40/652; 40/666; 211/10

[58] Field of Search ..... 209/546, 702, 209/900, 630, 706; 211/10, 11, 184; 40/652, 658, 666

[56] References Cited

U.S. PATENT DOCUMENTS

| | | | |
|---|---|---|---|
| 2,170,586 | 8/1939 | Canfield | 40/666 |
| 2,276,490 | 3/1942 | Hoofer | 40/652 X |
| 3,070,234 | 12/1962 | Deitchman | 211/10 |
| 3,747,752 | 7/1973 | Reader | 211/10 X |
| 4,732,279 | 3/1988 | Gurkin | 209/900 X |
| 4,795,042 | 1/1989 | Klein et al. | 209/702 X |

FOREIGN PATENT DOCUMENTS

| | | | |
|---|---|---|---|
| 1450890 | 1/1989 | U.S.S.R. | 209/702 |

*Primary Examiner*—William E. Terrell
*Assistant Examiner*—Tuan Nguyen
*Attorney, Agent, or Firm*—Joseph B. Taphorn

[57] ABSTRACT

A novel mail carrier sorting case arrangement facilitates the sorting of mail according to current conditions. Compartments formed in a case by vertical dividers are provided for each delivery address. Flags reflecting special current delivery situations with respect to particular addresses are temporarily placed across the entrances to corresponding compartments which must be noted by the sorting mail carrier when inserting the mail. The flags are obstructions which will be noticed physically if not visually, and may be readily deflected. The flags are formed of a strip of flexible material mounted on one end on a spring clip readily attachable to and removable from a divider. A flag has one bending point about which the free end of the strip moves inward facilitating the easy insertion of a single piece of mail into the compartment. The strips may be color coded to indicate broad categories of special situations, and may bear readily mounted and removed information cards which carry detailed instructions.

11 Claims, 2 Drawing Sheets

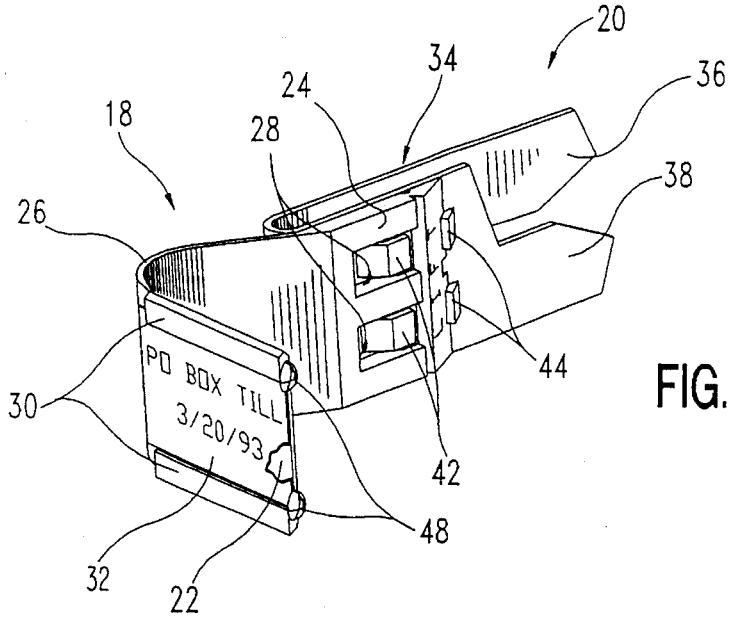
FIG. 3
FIG. 4
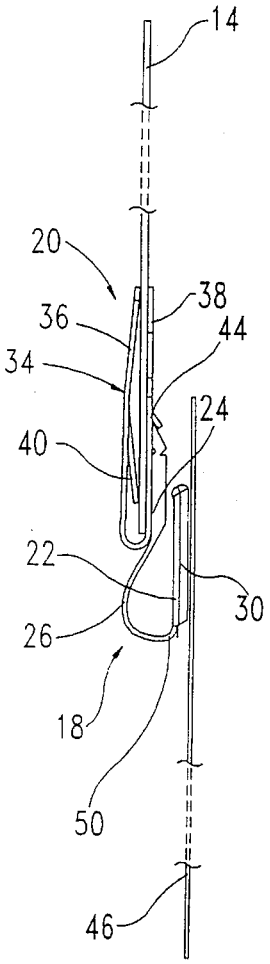
FIG. 5
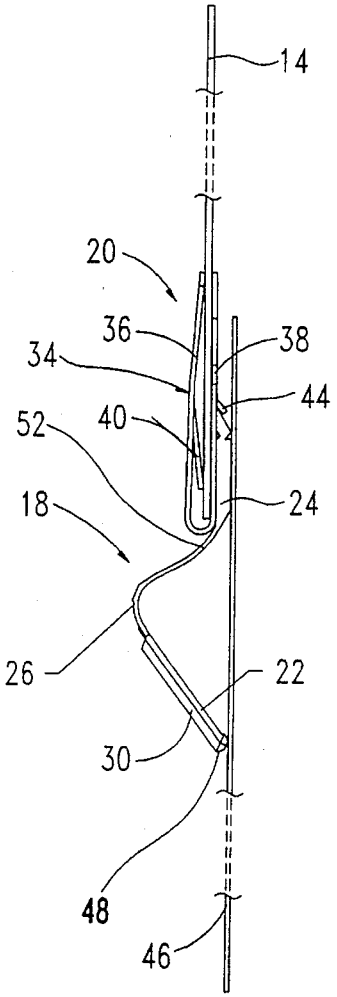
FIG. 6
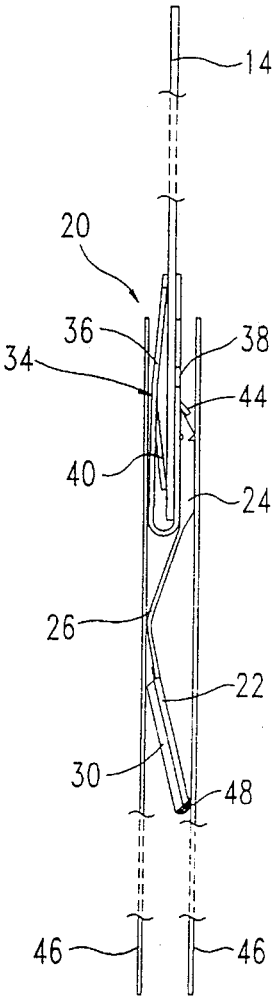

SORTING DEVICE AND METHOD

INTRODUCTION

1. Field of the Invention

This invention relates to sort-assisting devices and methods, and more particularly to a sort-assisting device and method for facilitating mail carrier sorting of his delivery route mail according to special instructions.

2. Background of the Invention

Mail carriers sort the mail they are scheduled to deliver on their route that day, using a case containing shelves having forwardly and upwardly opening compartments separated by dividers. Each compartment normally is for one or two street addresses on the carrier's route. The carrier sorts the mail he is to deliver, placing the individual items of mail into the compartments for the corresponding street addresses. He then removes the sorted mail from the compartments by typically grasping several compartments of mail at one time and pulling the mail from the case. According to the order the corresponding addresses will be reached on the route he will travel, he places the mail on trays which are accessed respectively as the mail delivery route is travelled.

Occasionally, special instructions obtain for a street address. For example, the intended recipient of the mail may have moved, and the mail needs to be forwarded to a new location. Or the intended recipient may have left town for a period of time, wishing to have the mail held up until he picks it up for delivery to resume at a certain date. Or several parties may reside at one address, and special instructions obtain for one or more parties. Additionally, these special instructions must be clearly conveyed to the substitute carrier who will deliver the mail on a particular route one day out of the six day delivery week and also on sick and vacation time of the regular carrier.

Keeping track of all of the ever changing special instructions with changing personnel is a difficult task.

SUMMARY OF THE INVENTION

Accordingly, it is an object of the invention to facilitate sorting operations so that special circumstances may be readily and easily accommodated.

A more specific object of the invention is to facilitate mail carrier sorting operations so that special instructions such as to forward the mail of a moved resident or to hold the mail of a temporarily absent resident, are better accommodated.

A further object of the invention is to enable a case structure that materially enhances a mail carrier's convenience in sorting mail for delivery on his route.

Another object of the invention is to provide a device for converting a conventional sorting case into one specially suited to a particular mail carrier's circumstances.

Yet another object of the invention is to devise a method for increasing a mail carrier's efficiency in sorting mail.

These and other objects, features and advantages of the invention are achieved through the provision of a device readily applied across the opening of a particular compartment to lightly obstruct the insertion of mail into the compartment so that the carrier is certain to be reminded that special circumstances exist. The device is a yieldable strip of material secured on a spring clip so that when the spring clip is mounted on an adjacent divider, the free end of the yieldable strip of material extends across a particular compartment. When mail is placed in that compartment, the free end of the strip may yieldably move inwardly while offering sufficient resistance to displacement so that the carrier is sure to notice physically that special instructions obtain. Or it may be yieldably moved outwardly by the carrier should he take visual notice.

The strip may be color coded to give an immediately appreciated visual clue as to the nature of the instruction. In addition, it may carry writing reflecting detailed instructions for the particular address that the compartment is for. On removal of sorted mail, the strip readily moves outwardly so as not to block the action.

Thus the yieldable strip or flag may be forced to bend in three distinct ways to accomplish its mission. These bends are predetermined by design and utilized as desired by the sorting person.

An advantage of the invention is that it provides the sorting person with visual and physical contact to gain his instant attention to sorting instructions. Not only does it instantly alert the sorting person, but it provides him or her with the information needed to act.

Another advantage of the invention is that by obstructing entrance to a particular sorting compartment, it is very hard to ignore particular information.

Still another advantage of the invention is that it does not unduly impede the flow of mail either in or out of the compartment.

A feature of the invention is that it meets U.S. Postal Service sorting needs by flagging sorting problems in its Carrier Case sections.

BRIEF DESCRIPTION OF THE DRAWINGS OF A PREFERRED EMBODIMENT

These and other objects, features, and advantages of the invention will become apparent from a reading of the following description of a preferred embodiment of the invention, when considered with the appended drawings, wherein:

FIG. 3 is a view in perspective of a strip of flexible material secured to a spring clip and bearing a card setting forth detailed instructions;

FIG. 4 is a top view of the strip of flexible material secured to a spring clip, when the strip is displaced inwardly to its extreme position by the insertion of a piece of mail into the associated compartment;

FIG. 5 is a top view of the strip of flexible material secured to a spring clip, when the strip is displaced outwardly to provide an alternative entry mode; and FIG. 6 is a top view of the strip of flexible material secured to a spring clip, when the strip is displaced outwardly as the mail is withdrawn.

DETAILED DESCRIPTION OF A PREFERRED EMBODIMENT

Figure 1:
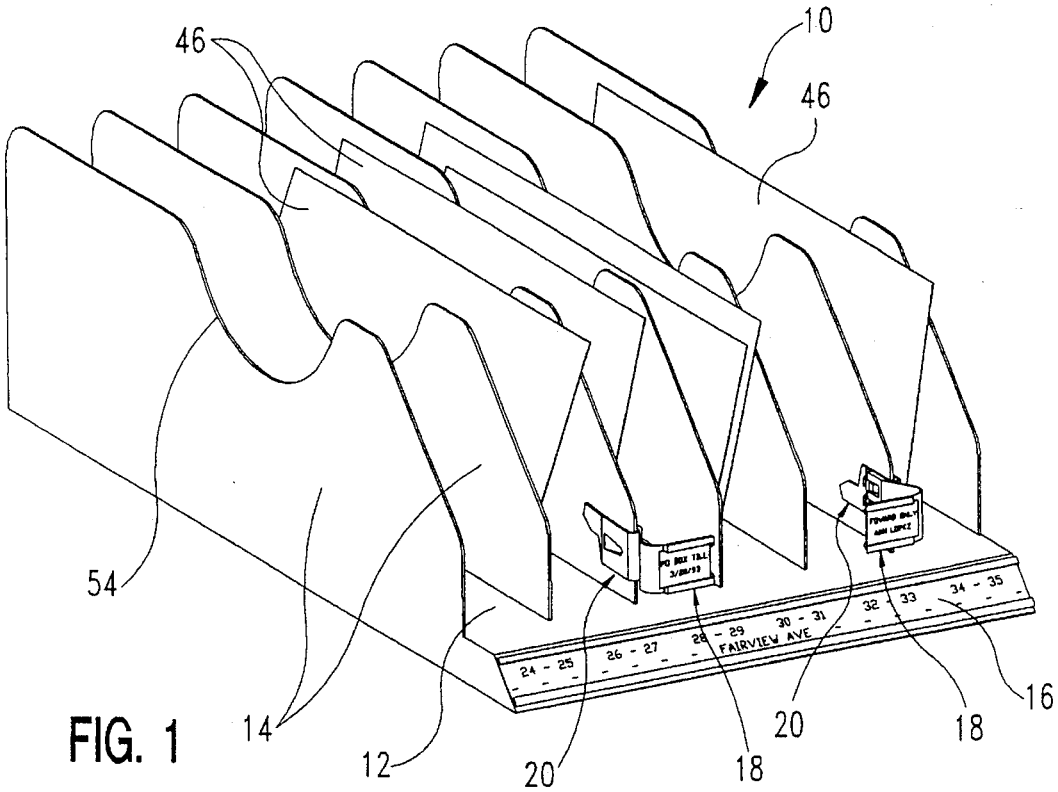
FIG. 1 is a view in perspective of a portion of a mail carrier sorting case incorporating devices having strips of flexible material extending across two compartments.
Figure 2:
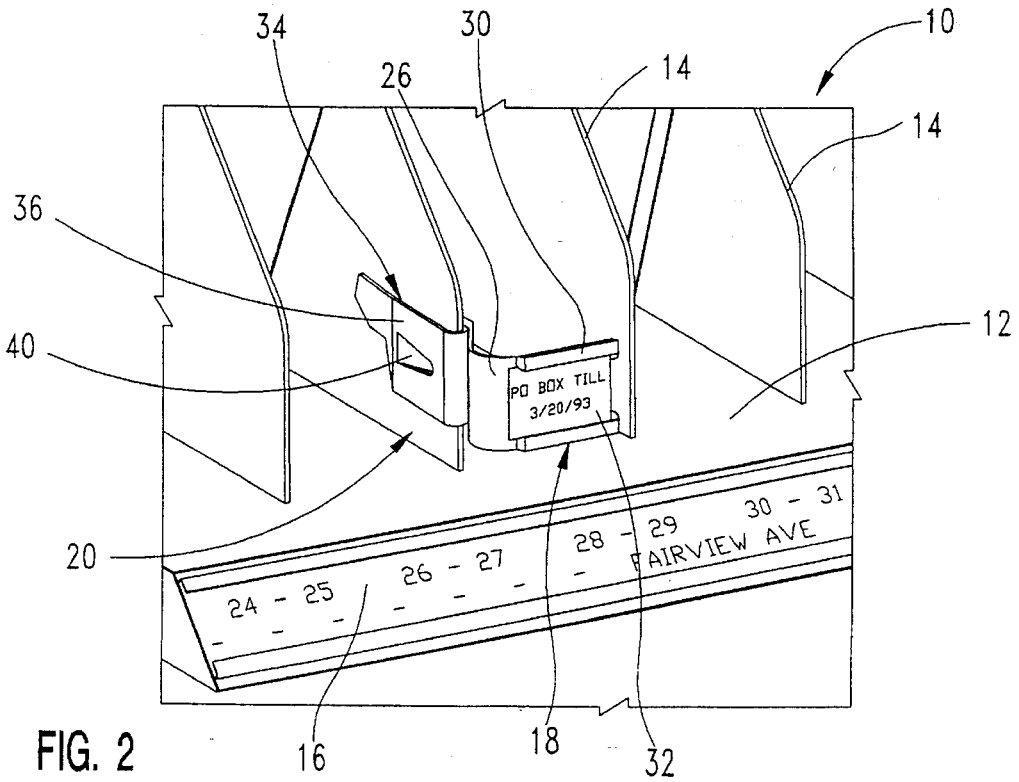
FIG. 2 is an enlarged view of a portion of the case of FIG. 1 incorporating a device having a strip of flexible material extending across a compartment.

Referring now more particularly to the drawings, there is shown in FIG. 1 a section of a conventional sheet-metal mail carrier sorting case generally indicated by the numeral 10 which has been modified according to applicant's invention. The case includes a floor or shelf 12 from which dividers 14 rise to define between them mail compartments for individual street addresses that may be set forth on a bar 16 extending across the case. Each divider 14 is constructed with a cut away area 54 which the carrier uses to grasp several compartments of mail at one time when removing mail from the case. Yieldable strips of material each generally indicated by the numeral 18 and secured to spring clips generally indicated by the numeral 20 mounted on respective dividers 14, extend in their normal rest position across the front end of corresponding compartments.

As best seen in FIGS. 2–6, a yieldable strip of material 18 has a first flat portion 22 for extending across the entrance to a compartment, a second flat portion 24 at right angles to the first flat portion for securing to the spring clip 20, and an intermediate curved portion 26 for interconnecting the two flat portions and accommodating three different forms of bending of the first flat portion with respect to the second. The strip may be formed of a flexible plastic such as polyethylene.

The free end of the second flat portion is formed with two apertures 28 to facilitate securing it to the spring clip 20. The outside face of the first flat portion is formed with bent over top and bottom parts 30 slightly spaced from the flat portion to define grooves wherein the upper and lower edges of an information bearing card 32 may be inserted.

The spring clip 20 may be of any conventional construction, but in the preferred embodiment it consists of a U-shaped portion generally indicated by the numeral 34 whose free ends on its legs 36 and 38 have the bottom portion of one and the top portion of the other cut away and the remaining portions bent in so that they will firmly grasp the thin metal divider 14 after having been placed thereon by slightly canting the clip. The outer leg 36 of the U-shaped portion has a flange 40 (FIGS. 2, 4, 5 and 6) cut out and its free forward end bent inwards to insure that the forward end of the clip firmly grasps the divider 14 too.

The inner leg 38 of the U-shaped portion 34 has two sets of small flanges or tabs 42 and 44 pressed outwardly and so that the free ends of the sets which face each other extend beyond the thickness of the strip second flat portion 24. In securing the strip 18 to the clip 20, the tip of the second-flat-portion free end is inserted inside the free ends of the outer set of small flanges 44 and pressure applied to the rest of the second flat portion to buckle it just inside its free end tip and set the apertures 28 on the inner set of small flanges 42 so that when the pressure is released the buckle disappears to secure the second portion free end in the inner and outer sets of flanges or tabs 42 and 44 and the second portion 24 itself against the inner leg 38 of the U-shaped portion 34 and hence the yieldable strip 18 on the spring clip 20.

The yieldable strip of material 18 may be of any of a number of colors so as to be color coded. Thus it might be of a red plastic to indicate a HOLD on the mail, of a blue plastic to indicate that a PO BOX obtains, green to indicate a NEW BOX HOLDER and who may have a dog or other hazard, or yellow to indicate FORWARD OR VACANT, all with the information card 32 marked appropriately.

To obstruct the case compartment for a particular address, the sorting person would select a yieldable strip of material 18 of a color appropriate to the message he desires himself or his substitute to be reminded of. He might write a message on a card 32 and insert the same into the grooves defined by the top and bottom parts 30 on the face of the first flat portion of the selected strip. He then might secure the strip second flat portion to the leg 38 of the U-shaped portion 34 of the spring clip 20 if not already secured to one, by inserting the tip of the free end of the second flat portion into the outer set of small flanges or tabs 44, applying further pressure to the second flat portion to buckle it and then placing its apertures 28 on the inner set of small flanges 42 and releasing the further pressure to let the buckle disappear and the free end of the second flat portion to seat itself upon the inner leg 38 of the U-shaped portion 34 of the spring clip 20. He would then mount the clip on the proper case divider 14, twisting or canting the clip somewhat to open up its receptability to the divider and then releasing it so that yieldable strip of material or flag 18 extends across the entrance of the compartment to be obstructed.

In mail sorting operations, mail is placed in compartments corresponding to the addresses on the individual pieces of mail being sorted. If a piece of mail obtains for a compartment whose entrance is obstructed by a yieldable strip of material extending across it, the sorting person may be alerted to the proper action by the coloring of it. If in his haste, he or she does not see strip 18, he will attempt to place the piece of mail into the compartment but will feel the interference occasioned by the strip 18 as it deflects under the mail insertion force. On either seeing or feeling, he is alerted to take the appropriate action.

On inserting a piece of mail 46, the yieldable strip of material 18 will be deflected inward perhaps to its extreme position as shown in FIG. 4. It should be observed that the bend in the intermediate portion 26 at 50 of FIG. 4 is controlled and forced to occur outward of the entrance to the compartment so that the flat portion 22 will not be captured and will return (redeploy) to the obstructing position of normal rest when the mail has been properly placed fully within the compartment. On removing several compartments of mail 46, the yieldable strip of material 18 will have been deflected outward as shown in FIG. 6 and not catch or otherwise impede the exit of the mail from an adjacent department. As the bend starts, all hindrance fades and the strip shape may approach a straight line as mail from groups of compartments is withdrawn with a single grasp.

FIGS. 3 and 5 show two smooth spheroid projections 48 extending outwardly on free end of the first flat portion 22. These are useful in instances of multiple flags and/or much mail, in that compartment entrance can be gained by a light sidewise touch of the smooth spheroid projections with a piece of mail forcing the flag to bend outward and away as in FIG. 5 to allow the mail to be inserted.

While there has been shown a preferred embodiment of the invention, it will be apparent to those skilled in the art that other and different applications may be made of the principles of applicant's invention. It is therefore desired to be limited only by the spirit or scope of the appended claims.

What is claimed is:

1. A sorting case arrangement for a mail carrier, comprising a shelf having dividers separating the case into mail receiving compartments with entrances each containing a path through which mail is inserted and removed, and a readily inwardly movable obstruction extending across an entrance path for signaling the mail carrier that special instructions apply to mail that would normally be placed in the particular compartment for the entrance, wherein the instruction is yieldably biased to extend across the entrance, and wherein the yieldably biased obstruction is a flexible strip having another bending action facilitating the removal of mail from the compartment.

2. A sorting case arrangement for a mail carrier, comprising a shelf having dividers separating the case into mail receiving compartments with entrances, and a readily inwardly movable obstruction extending across an entrance for signaling the mail carrier that special instructions apply to mail that would normally be placed in the particular compartment for the entrance; wherein the obstruction is yieldably biased to extend across the entrance; wherein the yieldably biased obstruction is a flexible strip; wherein the flexible strip has a bending point facilitating the insertion of individual items of mail into the compartment, which bending point is external of the compartment to facilitate redeployment of the strip to normal position after insertion of the mail into the compartment; wherein the obstruction has a free end, smooth projections formed on the free end, and a second bending point to allow the obstruction to be displaced by mail towards an open position by a light sidewise touch of the mail.

3. A sorting flag for a sorting case arrangement, for a mail carrier, involving a shelf having dividers separating the case into mail receiving compartments with entrances each containing a path through which mail is inserted and removed, comprising a flexible strip for extending across a compartment entrance path to signal the mail carrier that special instructions apply to mail that would normally be placed in the particular compartment for the entrance and for inward movement into the compartment, a mechanism affixed to one end of the strip and readily attachable to and detachable from a divider, and wherein the flexible strip having a bending point facilitating the insertion of individual items of mail into the compartment, which bending point is external of the compartment to facilitate redeployment of the strip to normal position after insertion of the mail into the compartment.

4. A flag according to claim 3, wherein the mechanism is a spring clip.

5. A flag according to claim 3, wherein the flexible strip is color coded.

6. A flag according to claim 3, wherein the flexible strip readily mounts an information card for detailed instructions.

7. A flag according to claim 3, wherein the flexible strip has a bending point about which the strip can be easily bent inwardly by mail being inserted into the compartment.

8. A flag according to claim 3, wherein the flexible strip has a bending capability about which the strip can be easily bent outwardly by mail being removed from the compartment.

9. A sorting flag for a sorting case arrangement, for a mail carrier, involving a shelf having dividers separating the case into mail receiving compartments with entrances, comprising a flexible strip for extending across a compartment entrance to signal the mail carrier that special instructions apply to mail that would normally be placed in the particular compartment for the entrance and for inward movement into the compartment, and a mechanism affixed to one end of the strip and readily attachable to and detachable from a divider; wherein the flexible strip has a bending point about which the strip can be easily bent inwardly by mail being inserted into the compartment; wherein the flexible strip has a second bending point about which the strip can be easily bent towards an open position by a light sidewise touch of the mail to allow mail to be inserted into the compartment unobstructed.

10. A flag according to claim 9, wherein the flexible strip has a free end and the free end of the flexible strip bears smooth projections for allowing the strip when the flag is mounted on a divider to be displaced by mail towards an open position by a light sidewise touch of the mail.

11. A sorting flag for a sorting case arrangement, for a mail carrier, involving a shelf having dividers separating the case into mail receiving compartments with entrances, comprising a flexible strip for extending across a compartment entrance to signal the mail carrier that special instructions apply to mail that would normally be placed in the particular compartment for the entrance and for inward movement into the compartment, and a mechanism affixed to one end of the strip and readily attachable to and detachable from a divider; wherein the mechanism affixed to one end of the strip bears two sets of flanges and the strip bears a set of apertures and the end of the strip sets behind the outer of the two sets of flanges and the apertures set under buckling pressure on the inner of the two sets of flanges.

* * * * *